US006126577A

United States Patent [19]

Chang

[11] Patent Number: 6,126,577

[45] Date of Patent: Oct. 3, 2000

[54] EXERCISE STATIONARY BICYCLE

[76] Inventor: Jeffery Chang, No. 2, Lane 13, Chang Chun Rd., Hsin-Tien City, Taiwan

[21] Appl. No.: 09/249,805

[22] Filed: Feb. 16, 1999

Related U.S. Application Data

[63] Continuation-in-part of application No. 09/148,141, Sep. 4, 1998, abandoned.

[51] Int. Cl.[7] ..... A63B 22/06

[52] U.S. Cl. ..... 482/57; 482/61; 434/61; 434/67; D21/663; D21/664

[58] Field of Search ..... 482/57, 61, 62, 482/63; 434/61, 67; D21/663, 664

[56] References Cited

U.S. PATENT DOCUMENTS 5,035,418 7/1991 Harabayashi ..... 272/73

*Primary Examiner*—Stephen R. Crow
*Assistant Examiner*—Tam Nguyen
*Attorney, Agent, or Firm*—Rosenberg, Klein & Lee

[57] ABSTRACT

An exercise stationary bicycle a base, a frame having a seat stay, a seat tube and a fork pivotally mounted on the base, and two hydraulic cylinders mounted between two sides of the fork and the base, whereby the frame may be swayed from side from side in riding thus making it to exactly simulate riding bicycles.

2 Claims, 4 Drawing Sheets

EXERCISE STATIONARY BICYCLE

CROSS-REFERENCE

This invention is a continuation-in-part of the patent application Ser. No. 09/148,141, filed Sep. 4, 1998, now abandoned.

BACKGROUND OF THE INVENTION

1. Field of the Invention

This invention is related to an exercise stationary bicycle and in particular to one which can exactly simulate riding a bicycle.

2. Description of the Prior Art

A number of exercise devices have been designed and developed to enable people to take exercise indoors. Example of the most popular exercise devices are treadmills for simulating walking and jogging, stationary bicycles for simulating riding bicycles, and rowing exercisers for simulating rowing boats and stationary bicycles are probably the best machines for a cardiovascular conditioning program. However, the frame of the conventional stationary bicycle is rigidly mounted at a fixed position thereby making it unable to simulate riding bicycles and causing the user to feel dull in a short period of time.

U.S. Pat. No. 5,035,418 discloses an exercise stationary bicycle comprising a base with a frame with a seat stay, a tube and a fork each pivotally mounted on the base and hydraulic cylinders which connect the fork and seat stay to the base. However, this exercise bicycle cannot automatically and rapidly move back to its upright position and is unstable in use thereby making it unfit for practical use.

Therefore, it is an object of the present invention to provide an improved exercise stationary bicycle which can obviate and mitigate the above-mentioned drawbacks.

SUMMARY OF THE INVENTION

This invention is related to an improved exercise stationary bicycle.

It is the primary object of the present invention to provide an improved exercise stationary bicycle which can be swayed from side to side in riding.

It is another object of the present invention to provide an improved exercise stationary bicycle which can exactly simulate riding a bicycle.

It is still another object of the present invention to provide an improved exercise stationary bicycle which can make a user to feel like riding a bicycle.

It is still another object of the present invention to provide an improved exercise stationary bicycle which is simple in construction and easy to manufacture.

It is a further object of the present invention to provide an improved exercise stationary bicycle which is good for a cardiovascular conditioning program.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
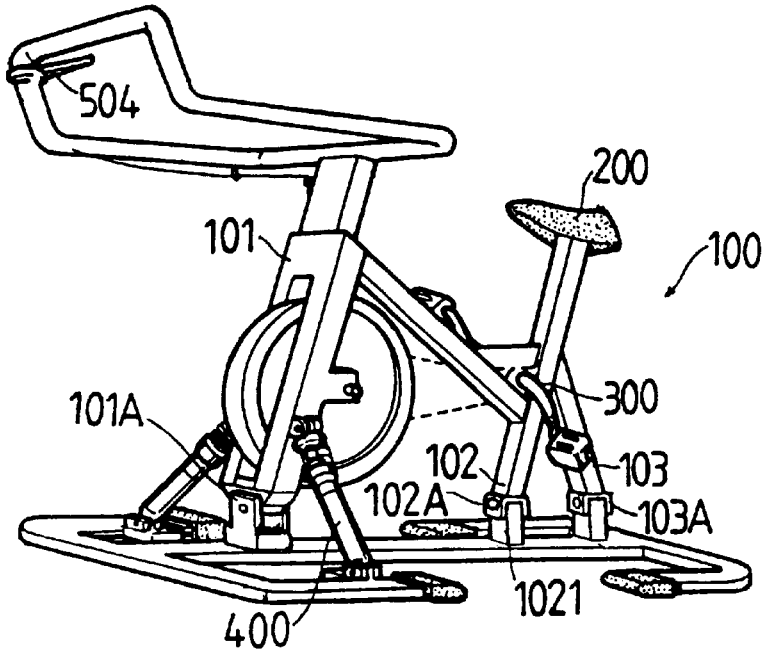
FIG. 1 is a perspective view of an exercise stationary bicycle according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
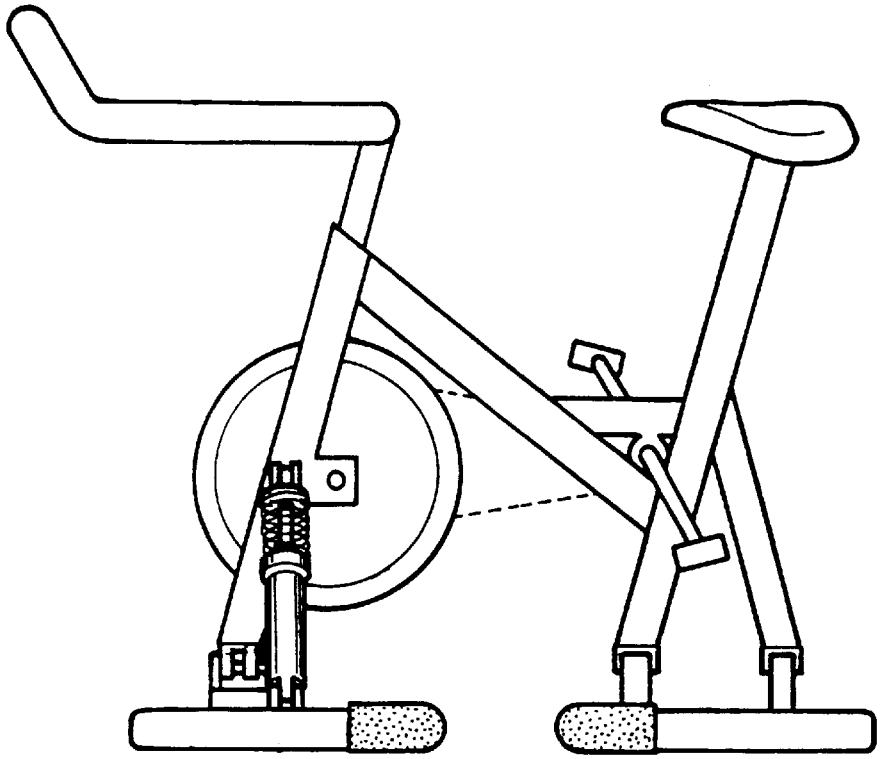
FIG. 3 is a side view of the present invention.
Figure 7:
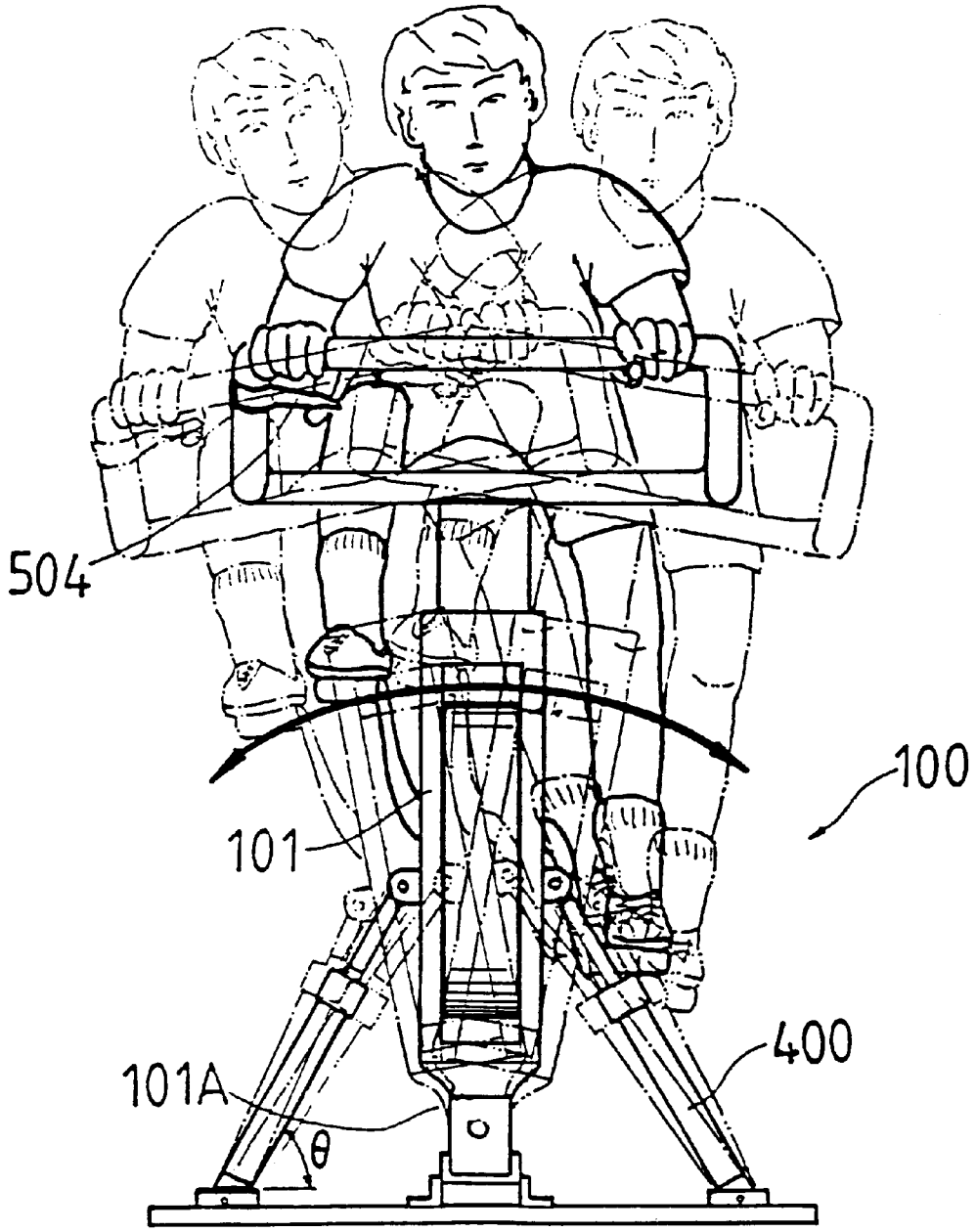
FIG. 7 is a working view of the present invention.

With reference to the drawings and in particular to FIGS. 1 and 3 thereof, the exercise stationary bicycle according to the present invention generally comprises a frame 100, a seat 200, a pedal driving mechanism 300, and a base 600. The frame 100 basically includes a fork 101, a seat tube 102 and a seat stay 103. The seat 100 and the pedal driving mechanism 300 are mounted on appropriate positions of the frame 100. The pedal driving mechanism 300 may be of any conventional design well known to the art and not considered a part of the invention. The lower ends of the fork 101, seat tube 102 and seat stay 103 are provided with pivot joints 101A, 102A and 103A, respectively. The base 600 has an elongated member 601 formed with a U-shaped portion 602 at both ends. The U-shaped portion 602 has two arms 603 at two sides each provided with an inwardly extending lug 608. Two hydraulic cylinders 400 are mounted between two sides of the fork 102 and the base 600. The hydraulic cylinder 400 has a piston rod 408 provided with a stop plate 409 at the upper end. A spring 403 is fitted over the piston rod 408 and arranged between the upper end 410 of the housing of the hydraulic cylinder 400 and the stop plate 409. The hydraulic cylinder 400 is arranged to make an angle θ from 50–80 degrees with respect to the base 600 (see FIG. 7) so that the two springs 403 will tend to urge two hydraulic cylinders 400 back to their original positions thereby automatically and rapidly moving the stationary bicycle back to its upright position.

Figure 2:
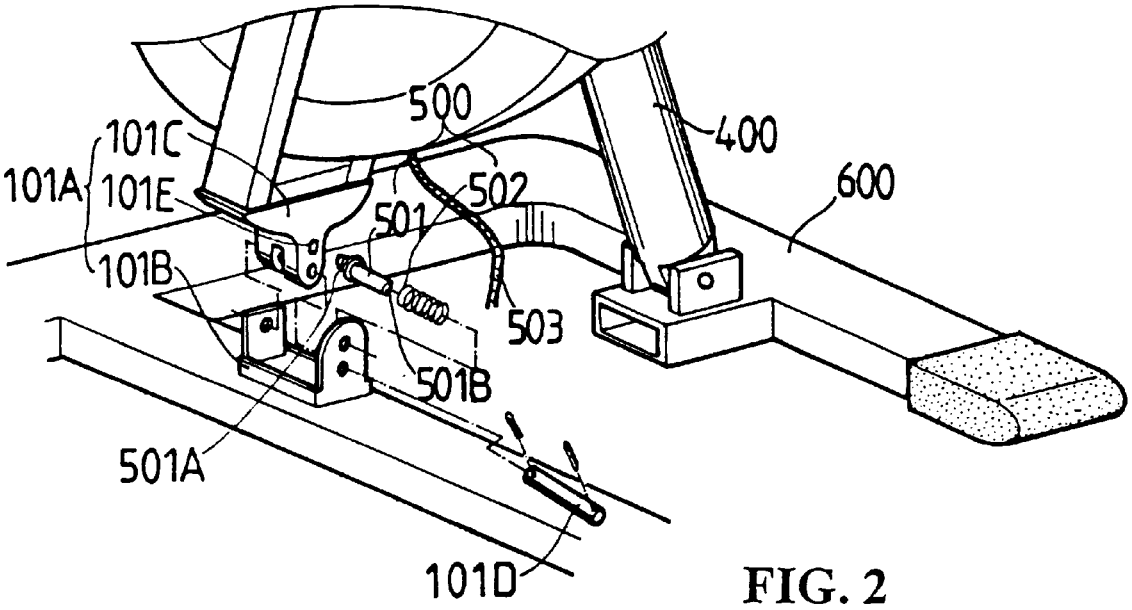
FIG. 2 is an exploded view of the pivot joint between the fork and the base.
Figure 8:
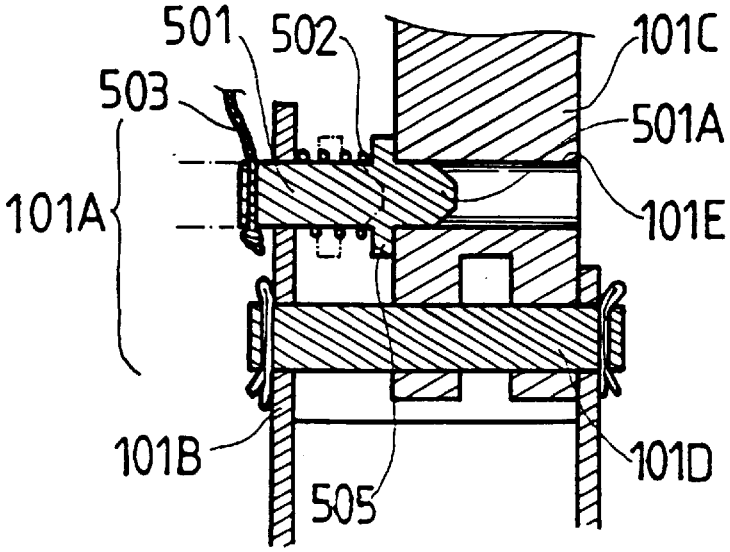
FIG. 8 is a sectional view illustrating the pivot joint and locking mechanism between the fork and the base.

Referring to FIG. 2, the pivot joint 101A includes a U-shaped seat 101B pivotally connected with a block 101C. The U-shaped seat 101B is rigidly mounted on the base 600, while the block 101C is fastened on the lower end of the fork 101. A pin 101D extends through the U-shaped seat 101B and the block 101C so that the fork 101 can be swayed from side to side with respect to the base 600 as desired. A locking mechanism 500 is arranged on the pivot joint 101A and includes a lock pin 501, a spring 502, a cable 503 and a control lever 504 (see FIGS. 1, 7 and 2). The lock pin 501 is formed with a flange 505 (see FIG. 8) at an intermediate portion thereof and is fitted in a hole of an upwardly extending lug of the U-shaped member 101B. The lock pin 501 has an end extending out of the U-shaped member 101B to engage with an end of the cable 503. The other end of the cable 503 is connected to the control lever 504. The spring 502 is fitted over the lock pin 501 and bears against the flange 505 of the pin 501 and an inner side of the lug of the U-shaped member 101B. The block 101C is formed with a hole 101E so that when the block 101C is disposed at a vertical position, the front end 501A of the pin 101E will be forced by the spring 502 to go into the hole 101E of the block 101C. Hence, when the control lever 504 is pressed, the cable 503 will be pulled upwardly thereby forcing the pin 501 to get out of the hole 101E (see the dotted lines of FIG. 8) and therefore enabling the pivot joint 101A to sway from side to side (see FIG. 7). As the rider releases the control lever 504, the spring 502 will force the tip 501A of the pin 501 to move toward the block 101C so that the tip 501A will go into the hole 101E when the hole 101E is aligned with the pin 501, thereby locking the bicycle at a fixed position. The tip 501A of the pin 501 has a conically shaped end for facilitating the engagement between the pin 501 and the hole 101E.

Figure 4:
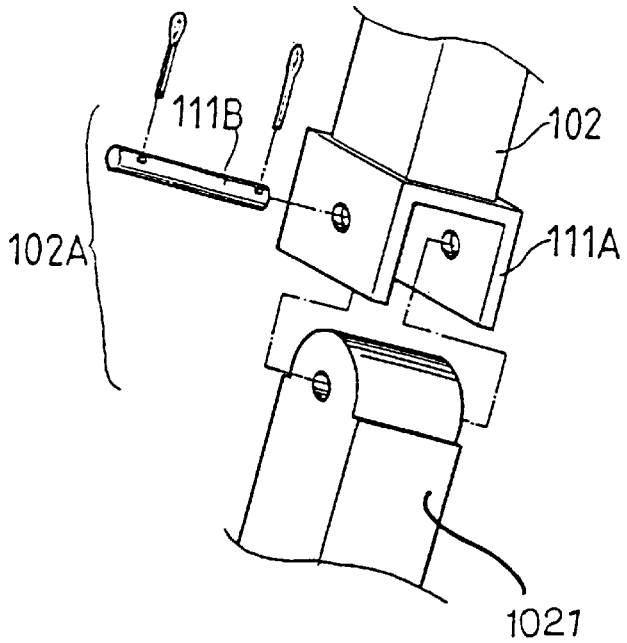
FIG. 4 is an exploded view of the pivot joint between the seat tube and the base.

Referring to FIGS. 1 and 4, the pivot joints 102A and 103A are of similar structure and only the pivot joint 102A is taken as an example to describe the structure thereof. The lower end of the seat tube 102 is formed with an inverted U-shaped member 111A. A seat member 1021 is fixedly mounted on the base 600. A pin 111B extends through the inverted U-shaped member 111A of the seat tube 102 and the seat member 1021 thereby forming the pivot joint 102A.

Figure 5:
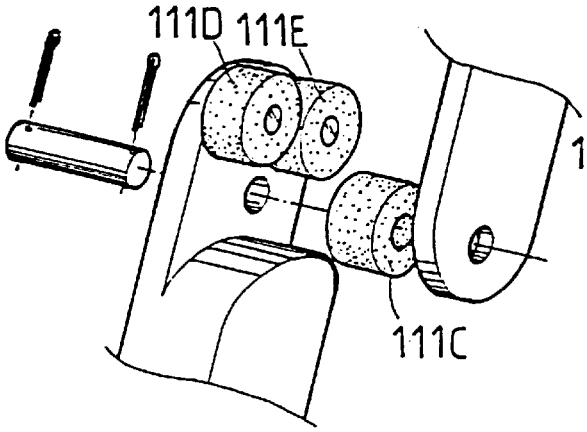
FIG. 5 illustrates a second preferred embodiment of the pivot joint between the seat tube and the base.
Figure 6:
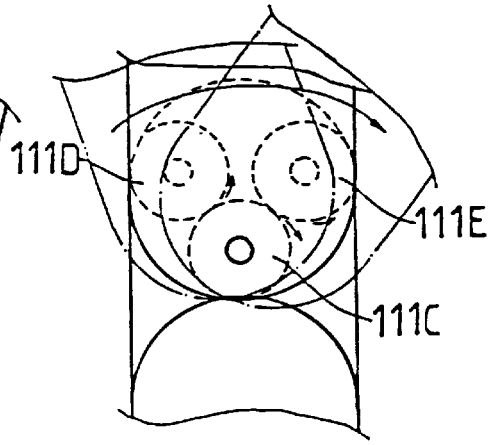
FIG. 6 illustrates how the second preferred embodiment of the pivot joint between the seat tube and the base works.

FIGS. 5 and 6 illustrate a second preferred embodiment of the present invention. As shown, the pivot joints 102A and 103A may be structured so that the lower end of the seat tube 102 is provided with a pivoted roller 111C and the seat member 1021 has two pivoted rollers 111D and 111E engaged with the pivoted roller 111C thereby enabling the tubular member 102 to sway from side to side with respect to the seat member 1021.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An exercise stationary bicycle comprising:

a base including an elongated member having front and rear ends, each of said ends being formed with a U-shaped portion, said U-shaped portion having two arms, each of said arms being formed with an inwardly extending lug;

a frame including a seat stay, a seat tubes and a fork pivotally mounted on said base, said fork having two sides;

a first hydraulic cylinder connecting one of said two sides of said fork to said inwardly extending lug of one said arm of said front end of said elongated member of said base, said first hydraulic cylinder including a housing, a first piston rod having an upper end provided with a first stop plate, a first spring fitted over said first piston rod and extending between said first stop plate and an upper end of said housing of said first hydraulic cylinder; and, a second hydraulic cylinder connecting another of said two sides of said fork to said inwardly extending lug of another said arm of said front end of said elongated member of said base, said second hydraulic cylinder including a housing, a second piston rod having an upper end provided with a second stop plate, a second spring fitted over said second piston rod and extending between said second stop plate and an upper end of said housing of said second hydraulic cylinder;

said frame being adapted thereby to lean from side to side during use.

2. The exercise stationary bicycle as claimed in claim 1, wherein said first and second hydraulic cylinders are each coupled to said base in pivotally displaceable manner to maintain an angular orientation with an approximating range of 50 to 80 degrees with respect to said base.

* * * * *